US006953362B2

(12) United States Patent
Mössner et al.

(10) Patent No.: US 6,953,362 B2
(45) Date of Patent: Oct. 11, 2005

(54) ELECTRICAL PLUG CONNECTOR WITH CABLE MANAGER

(75) Inventors: Frank Mössner, Berlin (DE); Ferenc Nad, Berlin (DE); Michael Gwiazdowski, Berchtesgadener (DE)

(73) Assignee: Krone GmbH, Berlin-Zehlendorf (DE)

( * ) Notice: Subject to any disclaimer, the term of this patent is extended or adjusted under 35 U.S.C. 154(b) by 0 days.

(21) Appl. No.: 10/344,491

(22) PCT Filed: Jul. 26, 2001

(86) PCT No.: PCT/EP01/08651

§ 371 (c)(1),
(2), (4) Date: Feb. 12, 2003

(87) PCT Pub. No.: WO02/15339

PCT Pub. Date: Feb. 21, 2002

(65) Prior Publication Data

US 2003/0171024 A1 Sep. 11, 2003

(30) Foreign Application Priority Data

Aug. 17, 2000 (DE) ..... 100 40 733
Oct. 14, 2000 (DE) ..... 100 51 097

(51) Int. Cl.[7] ..... H01R 4/24; H01R 13/514
(52) U.S. Cl. ..... 439/395; 439/676; 439/694
(58) Field of Search ..... 439/660, 676, 439/682, 692, 694, 344, 391, 395, 417, 426

(56) References Cited

U.S. PATENT DOCUMENTS 4,508,410 A * 4/1985 Canham ..... 439/395
4,872,849 A * 10/1989 Long ..... 439/395
4,934,953 A * 6/1990 Tenham et al. ..... 439/417
4,975,078 A * 12/1990 Stroede et al. ..... 439/405
5,061,209 A 10/1991 Bolick, Jr. et al.
5,074,804 A 12/1991 Pantland et al.
5,476,388 A 12/1995 Rutkowski
5,938,479 A * 8/1999 Paulson et al. ..... 439/676
6,305,950 B1 * 10/2001 Doorhy ..... 439/76.1

FOREIGN PATENT DOCUMENTS

DE 31 50 568 C1 2/1983
DE 0 445 376 B1 9/1991
DE 297 03 983 U1 5/1997
DE 299 15 553 U1 12/1999

* cited by examiner

*Primary Examiner*—Renee Luebke
(74) *Attorney, Agent, or Firm*—Merchant & Gould P.C.

(57) ABSTRACT

An electrical connector includes a connector housing (2) and a printed circuit board (3) with two sets of contact elements (7, 8). The first set of contact elements (7) is located on the front face of the printed circuit board (3) and protrudes into an opening in the plug connector housing (2). The second set of contact elements (8) is located on the rear face of the printed circuit board (3). The contact elements of the second set (8) are configured to form insulation-displacement contacts (8). The plug connector (1) also includes a cable manager (5) which has a continuous opening (13) and is configured on the front face (16) with guides (19) for cores or wires which are intended to make contact with the insulation-displacement contacts (8). The guides (19) in the region of the insulation-displacement contacts (8) are configured with recessed receiving elements or holders (20) for the insulation-displacement contacts (8), and the cable manager (5) can be latched to the plug connector housing (2).

27 Claims, 10 Drawing Sheets

ELECTRICAL PLUG CONNECTOR WITH CABLE MANAGER

FIELD OF THE INVENTION

The invention relates to an electrical plug connector, a cable manager for an electrical plug connector, a method for assembly of an electrical plug connector, and a tool for assembly and connection of the cores of the electrical plug connector.

BACKGROUND OF THE INVENTION

EP 0 445 376 131 discloses a plug connector for connecting a plug to electrically insulated conductors, having a housing which has a cavity to accommodate the plug, and with a first and a second set of connecting elements being provided. Each connecting element in the first set has an insulation-displacement contact for holding an insulated conductor and for making a contact connection with its core, and has a foot section. Each connecting element in the second set has a contact strip and a contact tongue, with each of the connecting elements in the second set being electrically connected via the contact tongue to the foot section of the connecting elements in the first set and extending from the first set to the cavity in order thus to make an electrical connection to the contacts fitted to the plug, and with the first and the second set of connecting elements being fixed in their position in the housing of the plug connector by guide means. The connection between the conductors and the insulation-displacement contacts is in this case made by means of known connection tools. In the process, the individual conductors or cores must be routed to the insulation-displacement contact and must be pressed into the insulation-displacement contact by means of the connection tool. One disadvantage of the known plug connector is its wide tolerances in its transmission response, which lead to major problems at high transmission rates.

SUMMARY OF THE INVENTION

The invention is thus based on the technical problem of reducing the tolerances in the transmission response of a plug connection. A further technical problem is the provision of a method for assembly of an electrical plug connector and of a tool for assembly of the plug connector, and for the connection of the cores of the electrical plug connector.

To this end, the plug connector comprises a cable manager which has a through-opening and is formed on the front face with guides for cores which are intended to make contact with the insulation-displacement contacts, in which case the guides in the region of the insulation-displacement contacts are formed with recessed holders for the insulation-displacement contacts, and the cable manager can be latched to the plug connector housing. This results in a number of major advantages in comparison to the prior art, which restrict the transmission response tolerances. The guides fix the length of the cores with which contact is to be made, in a defined manner. For this purpose, the respective core is passed through the openings and is inserted into the guides. Projecting parts of the core are then cut off at the edge of the cable manager, so that the length of the cores is the same in each plug connector. Furthermore, the guides mean that the cores can each all be located in a reproducible position with respect to one another. These two facts result in a fixed value for the crosstalk. A further advantage is that, once the cores have been fitted in the cable manager, contact between them and the insulation-displacement contacts can be made simultaneously, or virtually simultaneously.

To this end, the rear face of the cable manager is formed with an incline on one side. The cable manager and plug connector housing can be latched to one another without exerting any relatively high force, by means of an essentially, U-shaped tool like a bracket, on whose lower limb face, parallel-running guides are arranged which point inward, run at right angles to the rear wall of the tool, and are designed with obliquely running guide edges in the upper region on the inside of the limbs. In this case, the inclines on the cable manager and on the tool are aligned to be complementary to one another, so that the process of pushing the tool on leads to a travel movement, by means of which the cable manager is moved in the direction of the plug connector housing, so that the insulation-displacement contacts cut through the insulation on the cores and enter the holder within the guides. The transformation ratio from the sliding movement to the travel movement can in this case be varied via the gradient of the inclines.

A guide cross is preferably arranged in the opening in the cable manager, so that the cores are also guided in a defined manner within the openings. In the case of known RJ-45 plug connections, the associated core pairs are in this case each guided in one segment of the guide cross.

In order to reduce the defined crosstalk in the contact area as much as possible, the cores of different pairs are guided and made contact with at a distance from one another.

To this end, the guides run, for example, radially from the opening into the corners of the cable manager.

In another preferred embodiment, all the guides run parallel, but in different sectors of the cable manager.

In a further preferred embodiment, a hold-down device is arranged between the cable manager and the printed circuit board and allows the printed circuit board to be fixed with respect to the plug connector housing. Tensile forces on the cable, which would otherwise act on the printed circuit board, are thus absorbed.

In a further preferred embodiment, the guides are at offset levels in either direction with respect to one another, so that some of the cores make contact with one another at different times. This also results in the necessary contact forces being distributed better, so that the user requires less force for assembly and connection.

A cable grip is preferably arranged above the cable manager, in order to absorb tensile forces on the cable.

In a further preferred embodiment, the cable grip is designed with a number of parts, with the assembly tool at the same time forming a part of the cable grip.

To this end, the tool or the first part of the cable grip comprises two jaw parts which are located together and whose joint flexing can be limited by means of a spring which engages around the jaw parts and can be inserted at different points on the first part. A force-fitting connection to the cable can be produced by means of a third part, which can be latched to the first part and/or to the spring. In addition to the force-fitting connection, this multipart cable grip also allows cables of different diameter to be centered, which in turn has a positive effect on the tolerances relating to the transmission response.

In the case of cables with a shield, the cable grip can, furthermore, be used as a universal shield contact. To this end, the first and the third parts of the cable grip are either in the form of a die-cast zinc part or a metallized plastic part, which is or can be connected to a ground plate in the plug connector housing.

The various features of novelty which characterized the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 8 shows a side view of the electrical plug connector with the first part or tool partially pushed on;

DESCRIPTION OF THE PREFERRED EMBODIMENTS

Figure 1:
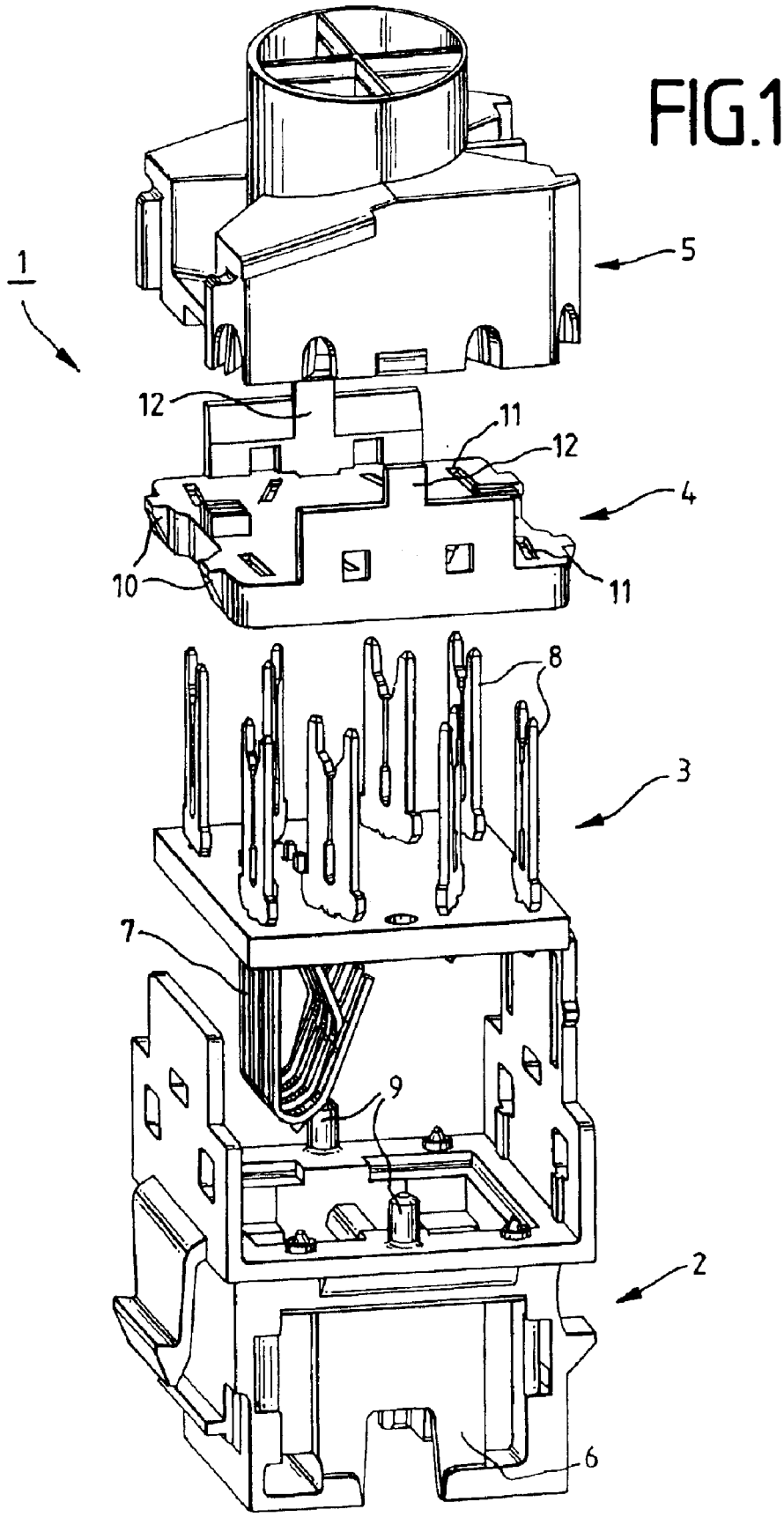
FIG. 1 shows an exploded illustration of a plug connector.
Figure 2:
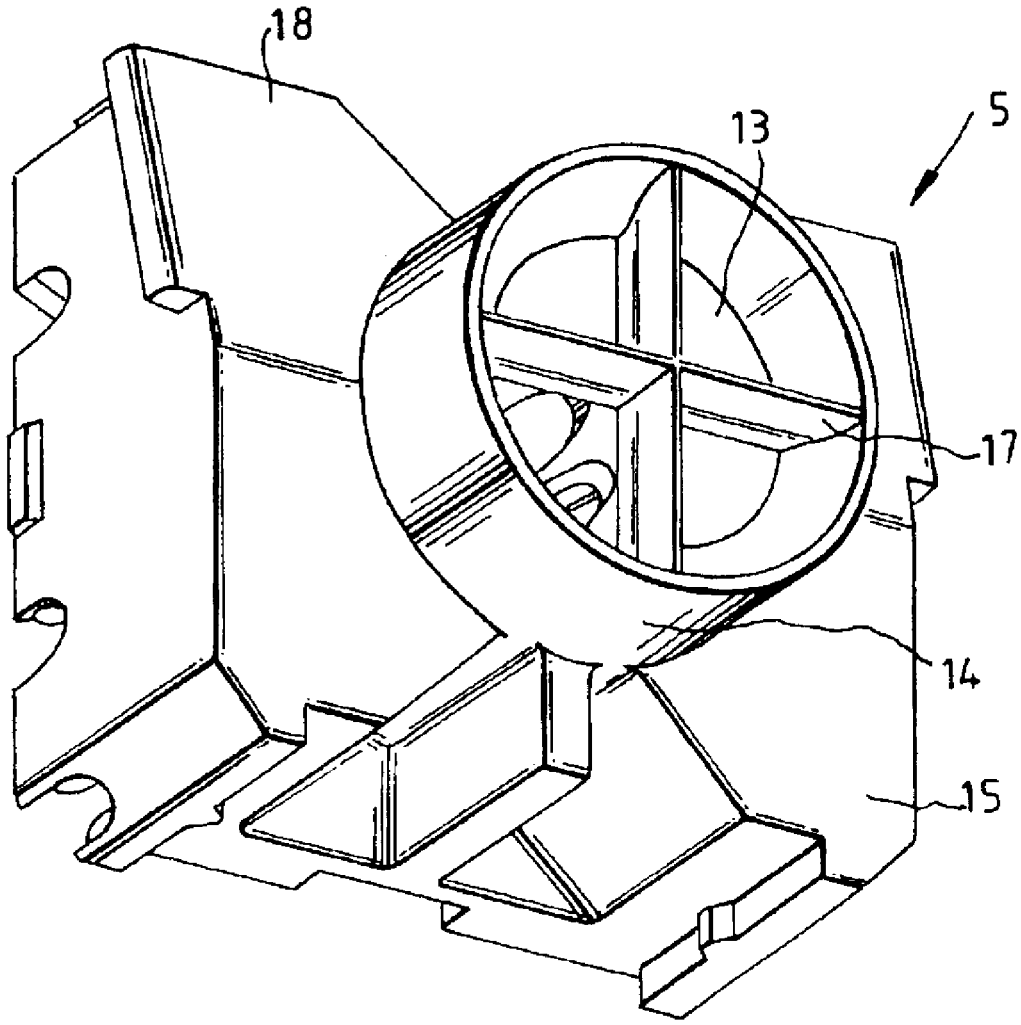
FIG. 2 shows a perspective illustration of a cable manager from the rear face.

Referring to the drawings in particular, FIG. 1 shows an exploded illustration of a plug connector 1. The plug connector 1 comprises a plug connector housing 2, a printed circuit board 3, a hold-down device 4 and a cable manager 5. The plug connector housing 2 in the illustrated examples is in the form of a socket housing with various latching and insertion means. The plug connector housing 2 is designated with a shielding plate 6 on the side surface. The printed circuit board 3 is fitted with a first set of contacts 7 on its front face and with a second set of insulation-displacement contacts 8 on its rear surface. One contact 7 in the first set is in each case connected to one contact 8 in the second set. The printed circuit board 3 is then inserted in to the plug connector housing 2. In the process, cylindrical pins 9 on the plug connector housing 2 pass through holes in the printed circuit board 3, so that the plug connector housing 2 and printed circuit boar 3 can be adjusted and fixed with respect to one another. The contents 7 in the first set, which are in the form of RF contacts, then project into an opening which is accessible from the front face of the plug connector housing. The hold-down device 4 is then pushed over the contacts 8 in the second set, and is latched to the plug connector housing 2. For this purpose, the hold-down device 4 is designed with latching tabs 10 on the face, and has through-openings 11 for the insulation-displacement contacts 8. Furthermore, the hold-down device 4 is designed with two latching hooks 12, which are used for latching to the cable manager 5. Before describing this assembly process, the cable manager 5 will first of all be explained in more detail with reference to FIGS. 2–4.

Figure 3:
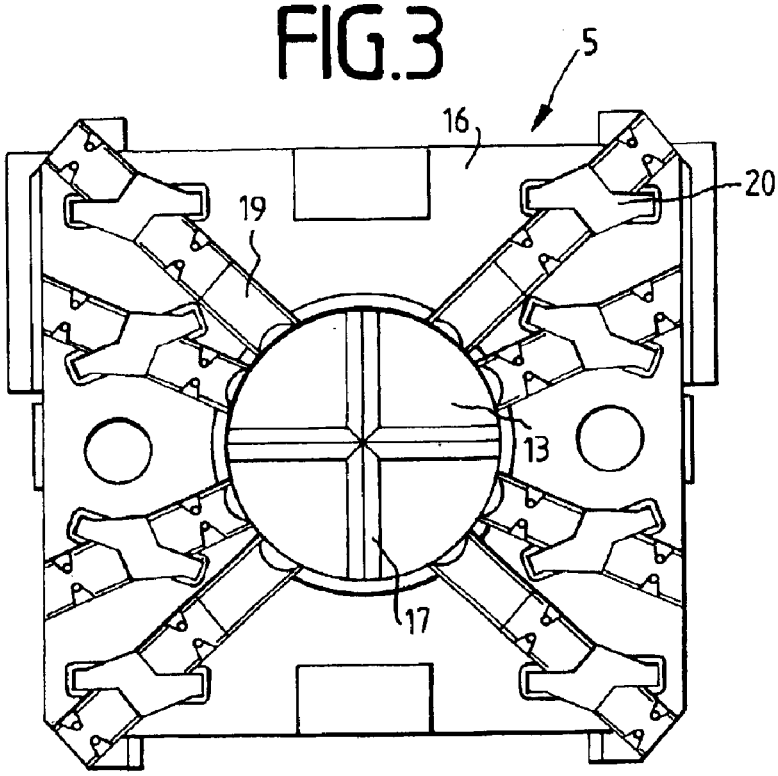
FIG. 3 shows a plan view of the front face of a first embodiment of a cable manager.
Figure 4:
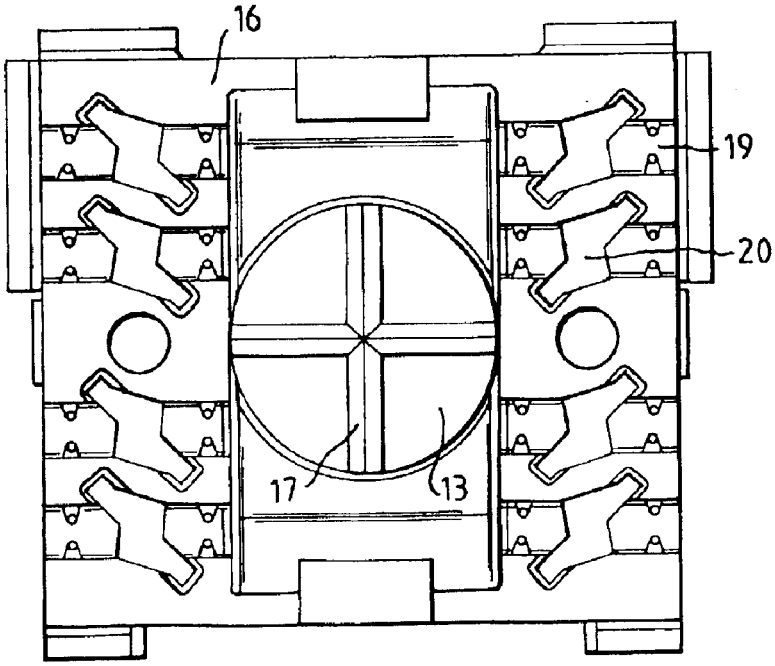
FIG. 4 shows a plan view of a front face of a second embodiment of a cable manager.
Figure 5:
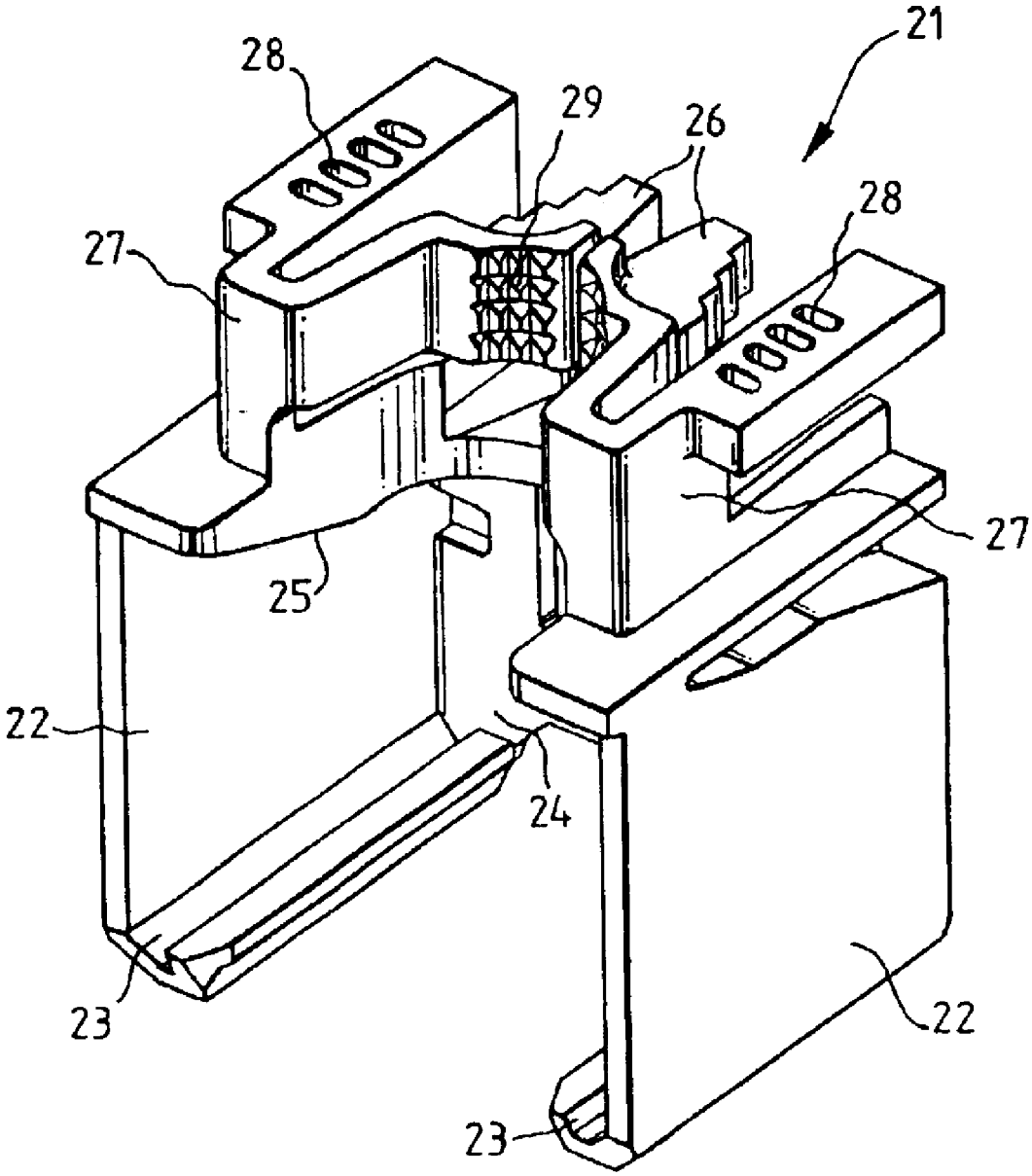
FIG. 5 shows a perspective illustration of a tool for assembling the plug connector, and/or a first part of a cable grip.

The cable manager 5 is essentially cuboid and has a central opening 13 around which a cylindrical attachment 14 is arranged. The opening 13 extends through from the rear face 15 to the front face 16. A guide cross 17 is arranged in the opening 13, and subdivides the opening 13 into four segments. Half of the rear face 15 is in the form of an incline 18. The cable manager 5 is designed with guides 19 on the front face 16, into which the cores with which contact is to be made can be inserted. Each guide 19 is designed with a recessed holder 20. The holders 20 are in this case arranged at the same positions as the insulation-displacement contacts 8 in FIG. 1. The guides 19 run either radially from the opening 13 to the edges of the cable manager 5 (as illustrated in FIG. 3), or each run parallel to one another (as illustrated in FIG. 4). In this case, if there are eight guides 19, as are required, by way of example, for a known RJ-45 plug connection, two guides 19 of a core pair are allocated to each quadrant. As can be seen from FIGS. 3 and 4, the holders 20, and thus the insulation-displacement contacts 8 of the various pairs, are relatively far away from one another, so that the crosstalk is reduced. In preparation for the actual contact-making process, the cores are passed in pairs from the rear face 15 to the front face 16. In this case, colored markings can be used both on rear face 15 and n the front face 16, in order to associate the core pairs with correct segments, and the cores with the correct guides 19. Once the cores have been pressed into the guides 19, they are cut off along the side edges. In principle, the cable manager 5 together with the plug connector housing 2 and the hold-down device 4 could now be latched to one another by finger pressure, although this would require a not inconsiderable amount of force to be used. A tool 21 is thus preferably used which, if required, can at the same time form a first part of a cable grip. This tool 21 is illustrated in perspective in FIG. 5.

Figure 8:
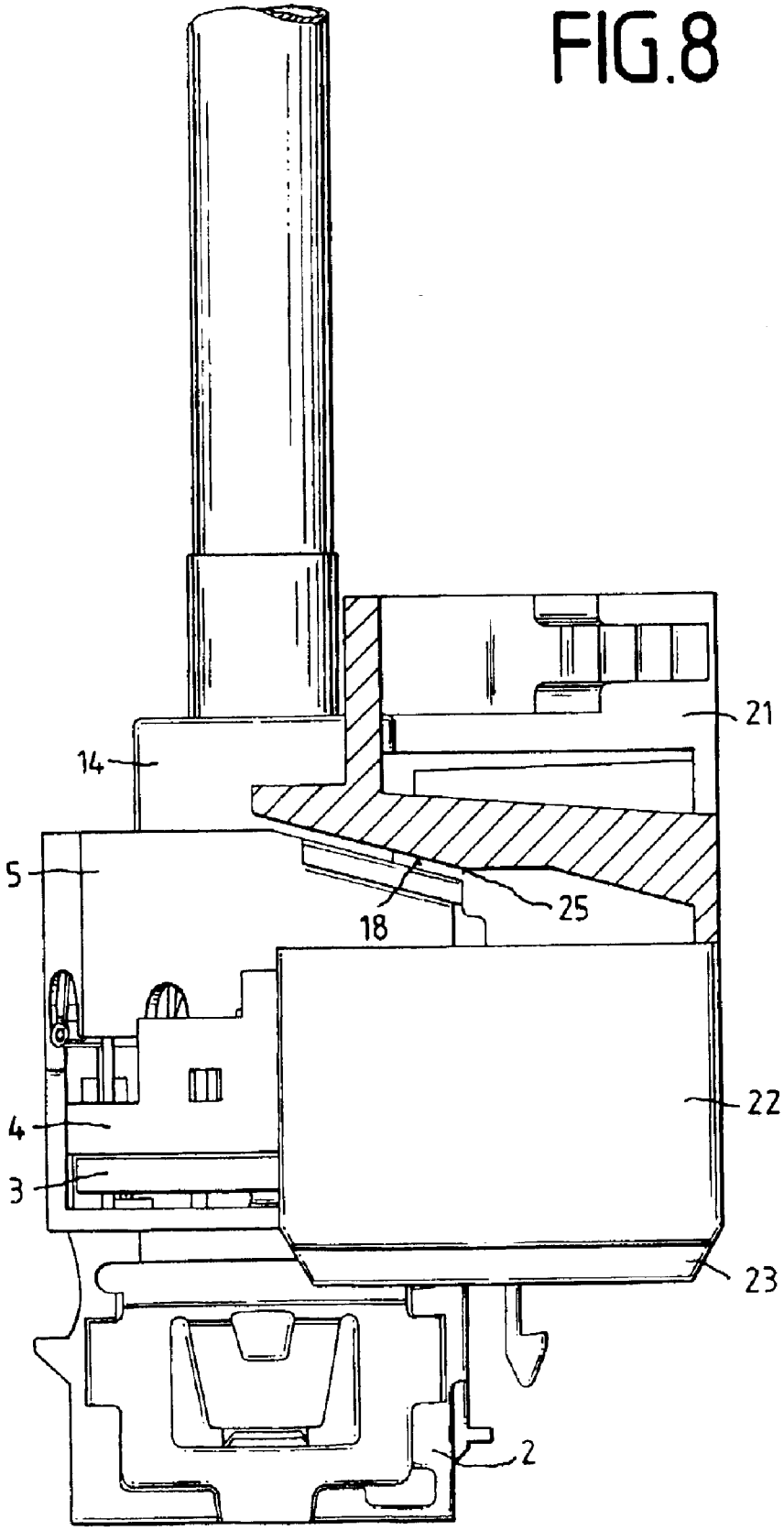

The tool 21 is essentially U-shaped with two side walls 22, which act as limbs. A guide 23, which points inward, is arranged on the lower face of each of the side walls 22. The two guides 23 run parallel and are at right angles to a rear wall 24. A guide edge 25, which likewise points inward and runs obliquely to the rear, is arranged on the upper face of each of the side walls 22. The guide edge 25 is in this case complementary to the incline 18 on the cable manager 5 shown in FIG. 2. In order to make contact, the tool 21 is then pushed onto the incline 18 on the cable manager 5, as is shown in FIG. 8, with part of the side wall 22 being cut away in the illustration. The guide 23 in this case runs parallel along one edge on the plug connector housing 2, so that the two inclines 18, 25 result in the cable manager 5 being pressed downward in the direction of the hold-down device 4. In the process, the insulation-displacement contacts 8 are pressed into the holder 20, and make contact with the cores located in the guides 19.

Furthermore, the tool 21 has two jaw parts 26 which flex jointly and are articulated in a sprung manner on a base 27 which is arranged on the upper face of the guide edges 25. There are jaw parts 26 in the form of steps at the sides. There are four openings 28, which are in the form of elongated holes, at each of the two sides on the upper face of the base 27. In the inner region, the two jaw parts 26 have pyramid-like structures 29. This tool 21 can now be used together with a spring 30, which acts as a locking means, and a closure element 31 as a cable clamp with a defined force fit and a defined centering for cables of different diameter.

Figure 6:
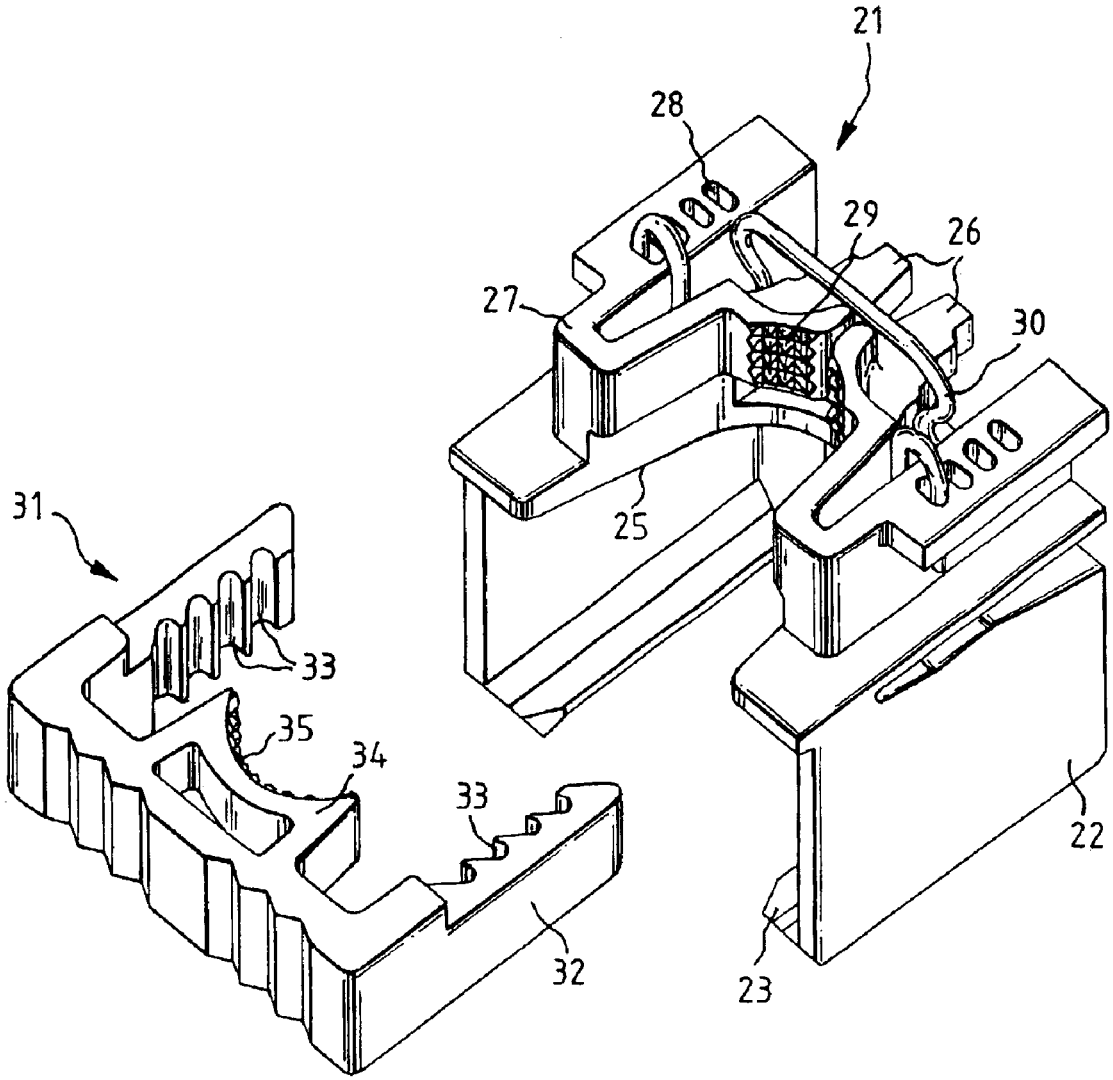
FIG. 6 shows a perspective illustration of a cable grip in the open state.
Figure 7:
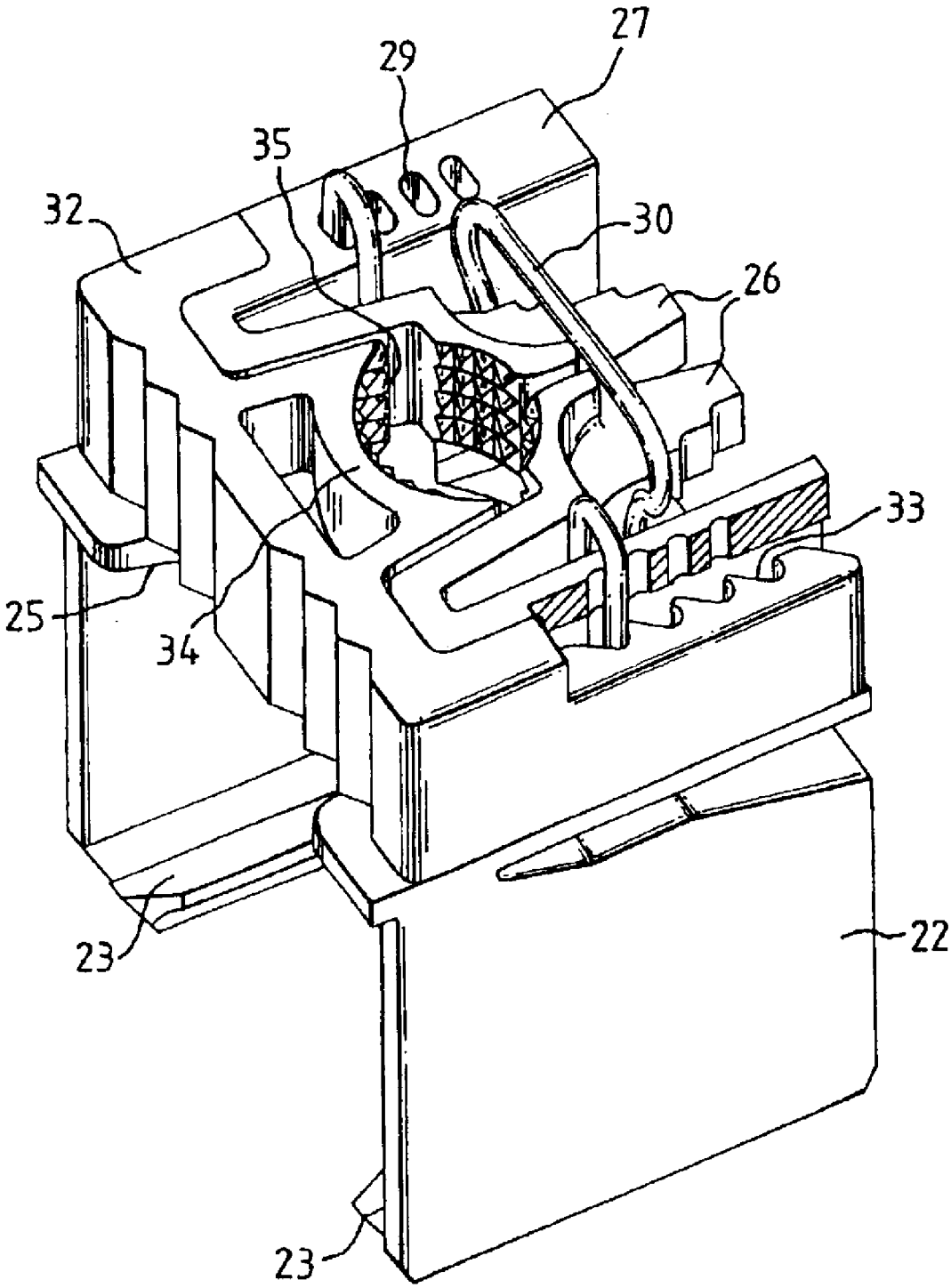
FIG. 7 shows a perspective illustration of a cable grip in the closed state without any cable.

FIG. 6 shows such a cable clamp. As can be seen from the illustration, the two jaw parts 26 can be pressed together to different extents by virtue of the stepped design, depending on the pair of openings 28 into which the spring 30 is inserted. In the illustrated example, the two jaw parts 26 are pressed together to the maximum extent, so that the holder formed in the region of the structures 29 has its maximum diameter. The closure element 31 is essentially U-shaped. Latching grooves 33, which act as barbs and run obliquely to the rear, are arranged on the insides of the limbs 32. The number of latching grooves 33 in this case corresponds to the number of openings 28. Furthermore, the closure element 31 has a curved attachment 34, likewise with pyramid-like structures 35 formed on the inside. A cable can now be fixed in a defined, force-fitting and centered manner by means of the cable clamp. In this case, it may be assumed that the cable clamp will be used for force-fitting connection with cables whose diameters are 6, 7, 8 or 9 mm. If it is intended to fix a 6 mm cable, then the spring 30 is first of all inserted into the first openings 28, so that the jaw parts 26 are pressed together to the maximum extent. The closure part 31 above the guide edge 25 is then pushed onto the base 27 until the rearmost latching groove 33 latches in on the spring leg of the spring 30. This is shown without a cable in FIG. 7, with a part of the base 27 having been cut away in the region of the openings 28 in the illustration. The barb-like shape of the latching grooves 33 results in robust latching, with a 6 mm diameter cable held between the structures 29, 35 always being fixed with the same force fit.

For unlocking, the spring legs of the spring 30 which have been inserted into the openings 28 are pressed in the direction of the jaw parts 26, and the closure element 31 or the spring 30 is pulled out once again. If, on the other hand, a 7 mm cable is now intended to be fitted, then the spring 30 is inserted offset by one opening 28 to the rear. The stepped outside of the jaw parts 26 means that they can now be pressed together to a lesser extent. In the process, the accommodation area for a cable is widened by 0.5 mm. Furthermore, the closure element 31 is pushed on only as far as the last-but-one latching groove 33, with the distance between the latching grooves 33 likewise being 0.5 mm. The increasing diameter is thus split equally between the tool 21 and the closure element 31, so that the center point of the cable is always located at the same point, even if the cable diameters differ. A corresponding situation applies to the increasing diameters, in that the spring 30 is offset in a corresponding manner to the rear, and the closure element 31 in each case latches on to a latching groove 33 whose width is less. When using shielded cables, the cable clamp can, furthermore, be used as a shield contact. To this end, the tool 21 and the closure element 31 are designed to be electrically conductive, with electroplated plastic parts preferably being used, in which case the tool 21 is or can be electrically connected to a ground plate in the plug connector housing 2.

Figure 9:
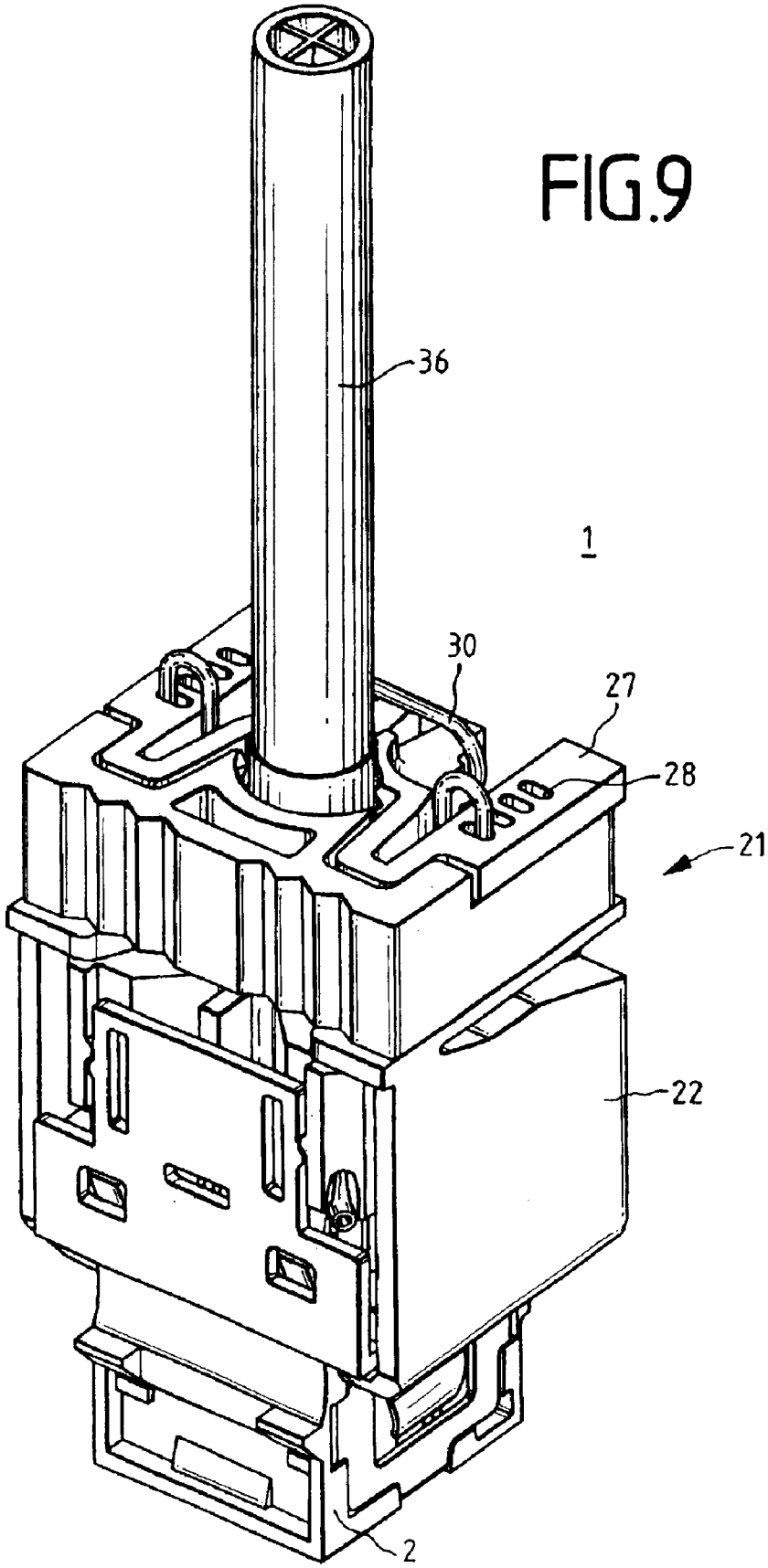
FIG. 9 shows a perspective illustration of the assembled plug connector with the cable grip and cable.

FIG. 9 illustrates a completely assembled plug connector 1, with a cable 36, in perspective.

Figure 10:
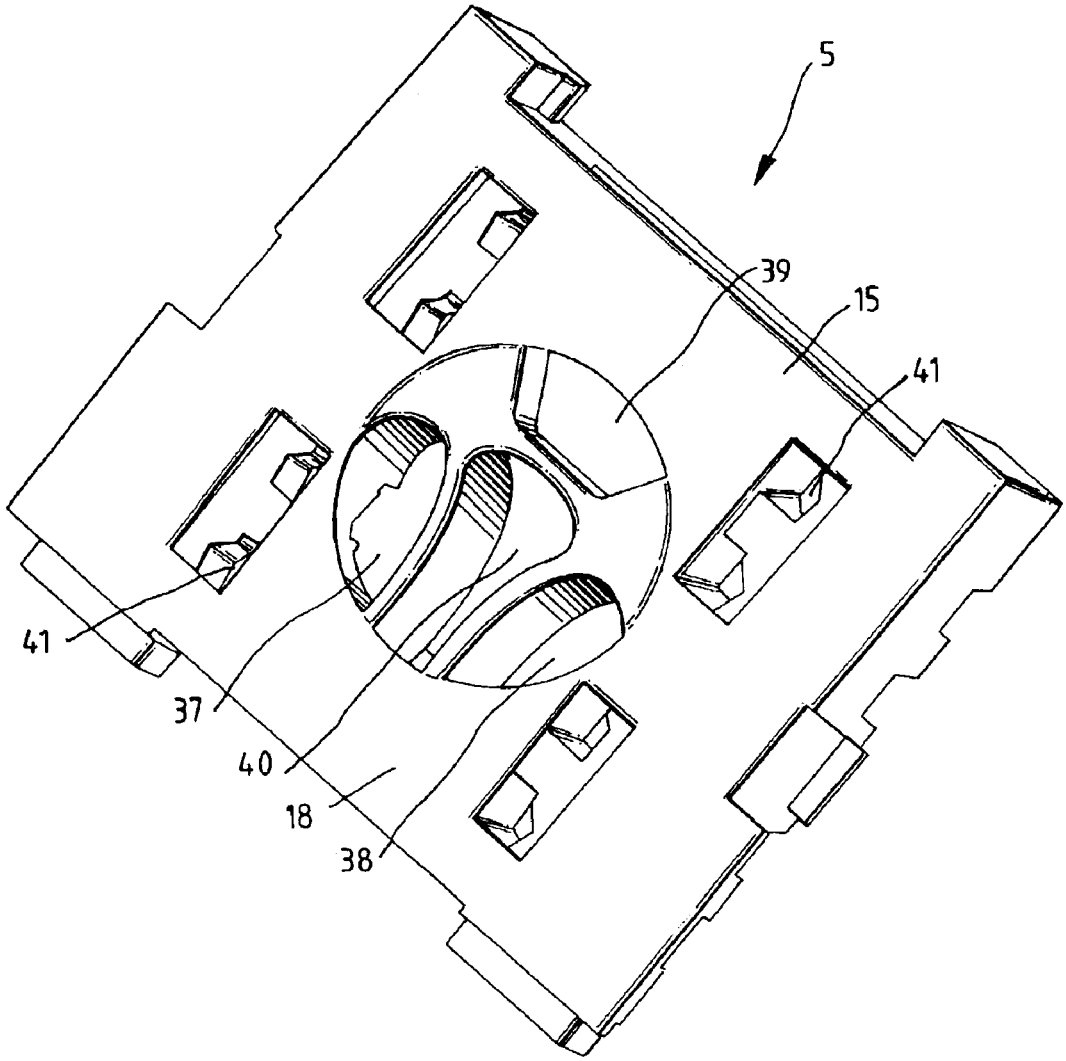
FIG. 10 shows a perspective illustration of a cable manager from the rear face.
Figure 11:
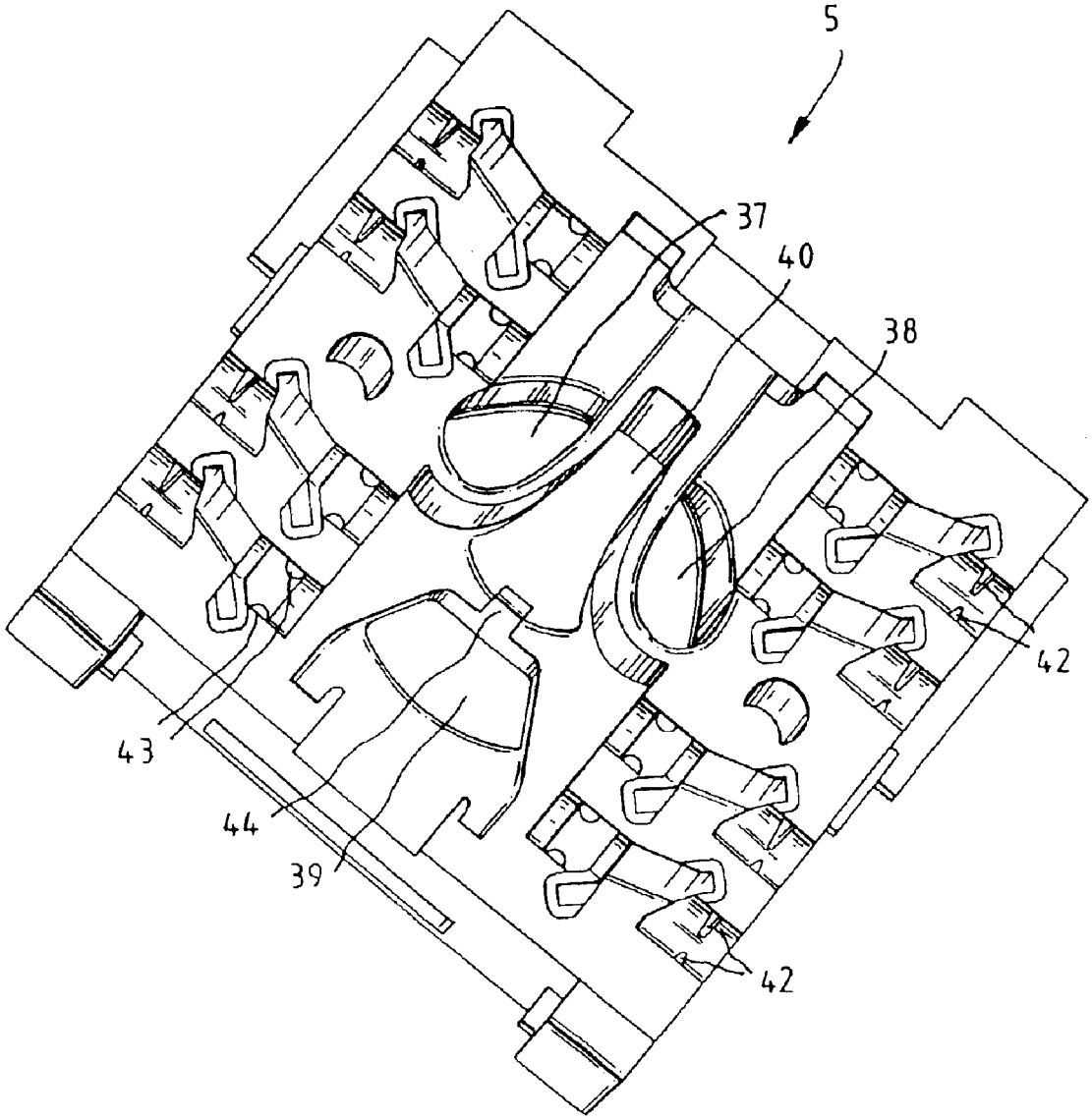
FIG. 11 shows a plan view of the front face of a third embodiment of a cable manager.

FIGS. 10 and 11 illustrate a third embodiment of the cable manager 5. The rear face 15 is once again designed with a cylindrical attachment 14 and an incline 18. In contrast to the embodiment shown in FIG. 2, the opening is not subdivided by a guide cross into four equal segments, and the channels 37–40 which extend from the front face 15 to the rear face 16 have different shapes. The two channels 37, 38 are each eye-shaped. The channel 39 is in the form of a segment of an annulus, and the channel 40 is in the form of a slot with a widened base. Furthermore, the cable manager has eight openings 41 as a result of the injection molding technique. As shown in the embodiment in FIG. 4, the guides 19 are each arranged parallel to one another, with two guides each being arranged in pairs in one quadrant. The guides 19 are each designed with a clamping rib 42 towards the side edges of the cable manager 5. Furthermore, the guides 19 are designed to each have two spherical elements 43 at their ends facing the channels 37–40, which spherical elements 43 are located in the region of the openings 41 and are used to hold the cores down. A guide web 44, whose function will be explained in more detail later, is arranged between the channel 39 and the channel 40. The region between the channels 37–40 and the associated guides 19 is in each case rounded, with a radius.

If the cable manager 5 is inserted on both sides of a cable, then two core pairs must be interchanged on one side owing to the mirror-image symmetrical constellation and, with free wiring, this leads to the crosstalk between these pairs increasing in an undefined manner. The guide web 44 is used to avoid this undefined crosstalk, and will now be explained in more detail in the following text with reference to RJ-45 wiring. An RJ-45 cable comprises eight cores, which are combined in pairs, with the two outer cores 1, 2 and 7, 8 forming a pair. The inner cores are combined crossed over, so that the cores 3, 6 and 4, 5 form a pair. The mirror-image symmetrical situation at the two ends of a cable as described above in this case means that either the two outer pairs or the two inner pairs must be interchanged at one end. In the following text, it is assumed that the inner pairs 3, 6 and 4, 5 are intended to be interchanged. The core pair 1, 2 is then arranged in the channel 37, the core pair 7, 8 in the channel 38, the core pair 3, 6 in the channel 39 and the core pair 4, 5 in the channel 40. The guides 19 in the upper left-hand quadrant are then permanently assigned to the core pair 1, 2, and the guides 19 in the upper quadrant are permanently assigned to the core pair 7, 8, independently of the side of the channel. The core pair 3, 6, on the other hand, must, depending on the cable side, be assigned firstly to the guides 19 in the lower left-hand quadrant and secondly to the guide 19 in the lower right-hand quadrant. A corresponding situation applies, but in the opposite sense, to the core pair 4, 5 in the channel 40. In this case, the guide web 44 makes it impossible for the two core pairs 4, 5 and 3, 6 to touch. Apart from providing detection against contact, a further function of the guide web 44 is to guide the two core pairs 4, 5 and 3, 6 as far away from one another as possible in a defined manner, in order thus to reduce the crosstalk. Alternatively, the guide web 44 may be semicircular or V-shaped, in order to provide better guidance, with the edges of the guide web 44 in each case being rounded in order not to kink the cores.

While specific embodiments of the invention have been shown and described in detail to illustrate the application of the principles of the invention, it will be understood that the invention may be embodied otherwise without departing from such principles.

What is claimed is:

1. An electrical plug connector, comprising:

a plug connector housing;

a printed circuit board;

a first set of contact elements;

a second set of contact elements, the first set of contact elements being arranged on a front face of the printed circuit board and projecting into an opening in the plug connector housing, the second set of contact elements being arranged on the rear face of the printed circuit board, the contact elements of the second set of contact elements being in the form of insulation-displacement contacts; and a cable manager having a front face and a rear face, the cable manager including:

a through-opening located in a central region of the cable manager, the through-opening extending from the front face to the rear face of the cable manager; and guides formed on the front face of the cable manager, the guides being configured to receive wire cores which are intended to make contact with the insulation-displacement contacts, the guides in a region of the insulation-displacement contacts being formed with recessed holders for the insulation-displacement contacts;

the cable manager being latchable to the plug connector housing.

2. The electrical plug connector as claimed in claim 1, wherein the guides are configured to guide the wire cores so that when the cable manager is latched to the plug connector housing, the wire cores are caused to make contact with the insulation-displacement contacts.

3. The electrical plug connector as claimed in claim 2, wherein a guide cross is arranged in the through-opening in the cable manager.

4. The electrical plug connector as claimed in claim 3, wherein the guides run radially with respect to the through-opening.

5. The electrical plug connector as claimed in claim 2, wherein the guides run parallel, with two guides being arranged in each quadrant of the cable manager.

6. The electrical plug connector as claimed in claim 2, wherein the rear face of the cable manager is formed with an incline on one side.

7. The electrical plug connector as claimed in claim 2, further comprising a hold down device arranged between the cable manager and the printed circuit board and allowing the printed circuit board to be fixed with respect to the plug connector housing.

8. The electrical plug connector as claimed in claim 2, wherein the guides of the cable manager are arranged at offset levels with respect to one another.

9. The electrical plug connector as claimed in claim 2, further comprising a cable grip arranged above the cable manager.

10. The electrical plug connector as claimed in claim 2, wherein the electrical plug connector forms a socket for an RJ-45 plug.

11. The electrical plug connector as claimed in claim 2, wherein the through-opening is divided into channels configured to separate the wire cores into pairs.

12. The electrical plug connector as claimed in claim 11, wherein the channels extend through from a the rear face of the cable manager to the front face of the cable manager.

13. The electrical plug connector as claimed in claim 2, wherein the through-opening is divided into four channels.

14. The electrical plug connector as claimed in claim 13, wherein a guide cross divides the through-opening into the four channels.

15. The electrical plug connector as claimed in claim 13, wherein the four channels comprise two eye-shaped channels, an annulus-shaped channel, and a slot-shaped channel having a widened base portion.

16. An electrical plug connector, comprising:

a plug connector housing;

a printed circuit board;

a first set of contact elements;

a second set of contact elements, the first set of contact elements being arranged on a front face of the printed circuit board and projecting into an opening in the plug connector housing, the second set of contact elements being arranged on the rear face of the printed circuit board, the contact elements of the second set of contact elements being in the form of insulation-displacement contacts;

a cable manager with a through-opening, the cable manager being formed on a front face with guides for wire cores which are intended to make contact with the insulation-displacement contacts, the guides in a region of the insulation-displacement contacts being formed with recessed holders for the insulation-displacement contacts, the cable manager being latchable to the plug connector housing; and a cable grip arranged above the cable manager, wherein the cable grip includes a number of parts including a first part with two jaw parts which flex jointly with a joint flexing limited in an adjustable manner by a spring engaging around the jaw parts, and with a third part closure element which can be latched in an adjustable manner to the first part and/or to the spring, whereby a cable to be attached can be centered in a defined, force-fitting manner.

17. The electrical plug connector as claimed in claim 16, wherein the first and the third part of the cable grip are in the form of metallized plastic parts which can be connected to a ground plate in the plug connector housing.

18. A cable manager for an electrical plug connector, the cable manager comprising:

a manager part having a front face and a rear face, the manager part defining an opening located in a central region of the manager Dart and extending from the rear face to the front face, the manager part including guides on the front face for wire cores which are intended to make contact with insulation-displacement contacts, the guides in a region of the insulation-displacement contact area including recessed holders for receiving the insulation-displacement contacts, wherein the manager part is configured for latching to a plug connector housing to form the electrical plug connector, thereby causing the wire cores to make contact with the insulation-displacement contacts.

19. The cable manager as claimed in claim 18, wherein a guide cross is arranged in the opening in the cable manager.

20. The cable manager as claimed in claim 18, wherein the cable manager has a cylindrical attachment in the region of the opening on the rear face.

21. The cable manager as claimed in claim 18, wherein the guides run radially with respect to the opening.

22. The cable manager as claimed in claim 18, wherein the guides run parallel, with two guides being arranged in each quadrant of the cable manager.

23. The cable manager as claimed in claim 18, wherein the rear face of the cable manager is formed with an incline on one side.

24. An electrical plug connector, comprising:

a plug connector housing;

a printed circuit board;

a first set of contact elements;

a second set of contact elements, the first set of contact elements being arranged on a front face of the printed circuit board and projecting into an opening in the plug connector housing, the second set of contact elements being arranged on a rear face of the printed circuit board, the contact elements of the second set of contact elements being in the form of insulation-displacement contacts;

a cable manager with a through-opening, the cable manager being formed on a front face with guides for wire cores which are intended to make contact with the insulation-displacement contacts, the guides in a region of the insulation-displacement contacts being formed with recessed holders for the insulation-displacement contacts, the cable manager being latchable to the plug connector housing; and a hold down device arranged between the cable manager and the printed circuit board and having openings for receiving the insulation displacement contacts, the hold down device being latchable to the cable manager and the plug connector housing so that when the cable manager, the hold down device, and the plug connector housing are latched together, the wire cores are caused to make contact with the insulation-displacement contacts.

25. The electrical plug connector as claimed in claim 24, wherein the through-opening of the cable manager is divided into channels, each of the channels being configured to receive a pair of the wire cores from the rear face of the cable manager and through to the front face of the cable manager.

26. A method for assembly of an electrical plug connector with a plug connector housing, a printed circuit board, a first set of contact elements, a second set of contact elements, the first set of contact elements being arranged on a front face of the printed circuit board and projecting into an opening in the plug connector housing, the second set of contact elements being arranged on a rear face of the printed circuit board, the contact elements of the second set of contact elements being in the form of insulation-displacement contacts and a cable manager with a through-opening located within a central region of the cable manager, the cable manager including guides for wire cores which are intended to make contact with the insulation-displacement contacts, the guides in a region of the insulation-displacement contacts being formed with recessed holders for the insulation-displacement contacts, the cable manager being latchable to the plug connector housing, the method comprising the following method steps:

inserting the printed circuit board into the plug connector housing;

passing the cores of a cable with which contact is to be made through the through-opening of the cable manager from a rear face of the cable manager to a front face of the cable manager, with the cores being pressed into the associated guides on the front face of the cable manager and being cut off at side edges of the cable manager;

aligning the cable manager with respect to the insulation-displacement contacts on the printed circuit board; and latching the cable manager to the plug connector housing, wherein the latching causes the cores to make contact with the insulation displacement contacts.

27. The method as claimed in claim 26, wherein the through-opening is divided into channels and the step of passing includes inserting each pair of the cores through a different channel of the through-opening.

* * * * *

UNITED STATES PATENT AND TRADEMARK OFFICE

CERTIFICATE OF CORRECTION

PATENT NO. : 6,953,362 B2
APPLICATION NO. : 10/344491
DATED : October 11, 2005
INVENTOR(S) : Mössner et al.

It is certified that error appears in the above-identified patent and that said Letters Patent is hereby corrected as shown below:

Col. 3, line 40: "illustrated examples" should read --illustrated example--

Col. 3, line 43: "side surface." should read --side surfaces.--

Col. 3, line 46: "on its rear surface." should read --on its rear face.--

Col. 3, line 52: "circuit boar 3" should read --circuit board 3--

Col. 3, line 59: "on the face, and" should read --on the end face, and-

Col. 4, line 21: "face 16. In this" should read --face 16 in one segment of the guide cross 17, and are pressed into the associated guides 19 on the front face 16.--

Col. 4, line 22: "on rear face 15 and n the front" should read --on the rear face 15 and on the front--

Col. 7, line 45, claim 12: "from a the rear face" should read --from the rear face--

Col. 8, line 26, claim 18: "manager Dart and extending" should read --manager part and extending--

Signed and Sealed this

Fifth Day of December, 2006

JON W. DUDAS
*Director of the United States Patent and Trademark Office*